US006089885A

United States Patent [19]

Nickel

[11] Patent Number: 6,089,885

[45] Date of Patent: Jul. 18, 2000

[54] SPARK PLUG CONNECTOR

[75] Inventor: Hans Nickel, Cottenweiler, Germany

[73] Assignee: Andreas Stihl AG & Co., Waiblingen, Germany

[21] Appl. No.: 09/293,780

[22] Filed: Apr. 19, 1999

[30] Foreign Application Priority Data

Apr. 21, 1998 [DE] Germany ..... 198 17 657

[51] Int. Cl.[7] ..... H01R 13/44

[52] U.S. Cl. ..... 439/127; 439/125

[58] Field of Search ..... 439/125, 92, 521, 439/607, 126, 127, 128, 860; 174/152; 313/137

[56] References Cited

U.S. PATENT DOCUMENTS

| | | | |
|---|---|---|---|
| 878,551 | 2/1908 | Mills . | |
| 3,965,879 | 6/1976 | Fitzner | 123/148 P |
| 5,348,486 | 9/1994 | Tura, Jr. et al. | 439/125 |
| 5,447,429 | 9/1995 | Nitta et al. | 439/125 |
| 5,788,905 | 8/1998 | Miller et al. | 264/267 |

FOREIGN PATENT DOCUMENTS 195 15 623 7/1996 Germany .

*Primary Examiner*—Lincoln Donovan
*Assistant Examiner*—Chandrika Prasad
*Attorney, Agent, or Firm*—Walter Ottesen

[57] ABSTRACT

The invention is directed to a spark plug connector which includes an electrically insulating housing having a spark plug receptacle. A contact element for electrically connecting to the connecting tip of the spark plug is mounted in the spark plug receptacle. The contact element can be displaced by the connection tip of the spark plug against a restoring spring force. The spark plug connector of the invention can be cost effectively manufactured and provides a reliable electrical insert connection. To make the spark plug connector, the housing is made of an elastic material and a clip spring, which is embedded in the housing material, is provided as a contact element. The legs of the clip spring have respective segments in a contact plane lying perpendicularly to the longitudinal axis of the receptacle. These segments are accessible for establishing a contact and delimit the smallest diameter of the spark plug receptacle. When pushing the spark plug connector onto the spark plug, the legs of the spring clip latch with these contact segments into a backcut formed peripherally on the connecting tip of the spark plug.

36 Claims, 3 Drawing Sheets

SPARK PLUG CONNECTOR

FIELD OF THE INVENTION

The invention relates to a spark plug connector having an electrically insulating housing. The invention also relates to a method for making a spark plug connector.

BACKGROUND OF THE INVENTION

Spark plug connectors define the electrical connection between a spark plug and an ignition voltage source and are pushed onto the connecting tip of a spark plug. A contact element of the spark plug connector establishes the connection between the center electrode of the spark plug and the ignition cable of the voltage source. The spark plug is usually for use in internal combustion engines. The electrode or electrodes project into the combustion chamber for the purpose of igniting the mixture.

Such a spark plug connector is disclosed in German patent publication 195 15 623. The housing of this spark plug connector is made of electrically insulating material and a contact element of electrically-conducting elastic material is mounted in this housing. A sleeve-shaped cable holder for the ignition cable is formed onto the housing of the spark plug connector. This cable holder includes an inwardly projecting cable connector which is in electrical connection with the contact element. The contact element is configured as a contact ring made of electrically-conducting elastic material such as silicon having a specific graphite content or an insert made of metal wires. The contact ring is held as an inserted component in a cylindrical recess of the housing. The housing itself is rigid. When the spark plug connector is pushed onto a spark plug, then the connecting tip of the spark plug penetrates the contact ring and widens the same. The restoring spring force of the expanded contact ring presses the inner surface of the contact ring against the connecting tip and ensures the electrical contact.

The elastic material of the contact ring makes possible only small spring deflections so that the restoring forces of the contact material are only adjustable with difficulty. Vibrations caused by the operation can lead to wear at the contact element whereby the contact force of the elastic ring can become scattered.

If a helical spring is used as a contact element in a spark plug connector, then the helical spring must be pressed axially upon the connecting tip of the spark plug. The helical spring too defines only short effective spring deflections so that large forces are required for pushing the spark plug connector onto the spark plug in order to ensure the required contact force of the helical spring. When disconnecting the insert connection, often very large pulling forces act on the helical spring which can lead to a permanent deformation and reduction of the spring action.

SUMMARY OF THE INVENTION

It is an object of the invention to configure the spark plug connector so that a reliable electrical insert connection is made possible and so that the spark plug connector can be cost-effectively manufactured.

The spark plug connector of the invention is for connecting an ignition cable to a spark plug having a connecting tip. The spark plug connector includes: an electrically insulating housing made of elastic material and defining a receptacle for accommodating the spark plug therein; the receptacle defining a longitudinal axis; a clip spring for providing an electrical contact to the connector tip of the spark plug; a cable holder for receiving the ignition cable therein; the cable holder being connected to the housing; the clip spring being embedded in the material of the housing; the clip spring having legs which develop a restoring force when deflected from a rest position; the legs having respective segments and the legs lying in a contact plane perpendicular to the longitudinal axis; the segments being disposed in the receptacle to conjointly delimit a smallest diameter thereof; and, the segments being displaceable against the restoring force as the connecting tip enters the socket and the segments being accessible to the connecting tip for providing an electrical contact therewith.

According to the invention, a simple and therefore cost effective configuration of the spark plug connector is achieved in that a clip spring is embedded in the elastic housing material. With this configuration, a high contact reliability is ensured. Rubber, for example, is advantageous as a housing material and is elastic and is also electrically insulating.

The clip spring itself is electrically conductive and defines the contact element of the spark plug connector. The legs of the clip spring have segments which are accessible for contacting from the spark plug receptacle. The contact segments of the legs of the clip spring delimit the smallest diameter of the spark plug receptacle in a contact plane lying perpendicularly to the longitudinal axis of the spark plug receptacle. When the spark plug connector is pushed onto the spark plug, then the connecting tip of the spark plug pushes the contact segments of the clip spring legs apart whereby the restoring forces of the clip spring ensure a permanent contact in the mounted position.

The clip spring exhibits an unchanged spring characteristic even after longer operating times under the influence of the vibrations of the internal combustion engine. Each of the legs of the clip spring lies against the connecting tip of the spark plug and defines a contact location for transmitting the ignition voltage.

A housing roof axially delimits the spark plug receptacle. Preferably, the contact plane lies at such a spacing from this housing roof that the contact segments of the legs of the clip spring can latch in a backcut which is formed about the periphery of the connecting tip of the spark plug. The latching of the legs of the clip spring can be clearly sensed and shows that the electrical contact between the connector and the spark plug is established.

The clip spring is advantageously configured to be approximately U-shaped with the clip spring legs lying parallel to each other so that the contact segments of the clip spring are pressed against the connecting tip of the spark plug approximately diametrically opposite each other. The clip spring can be bent in a simple manner from a spring wire which lies in a plane. The legs of the clip spring can be configured so as to have different lengths.

According to an advantageous embodiment of the invention, a free end of the clip spring (preferably the free end of the longer clip spring leg) projects into the cable holder and defines a connecting tip which engages into the ignition cable so as to be electrically conductive. In this way, a compact configuration of the spark plug connector is obtained. The ignition cable is advantageously connected at right angles to the longitudinal axis of the connector.

The clip spring can also be configured to have three or more legs. The spring wire advantageously has a circular cross section which defines one or more contact points per clip spring leg when lying against the spark plug in the groove defined by the backcut. Also, the spring wire can advantageously have a cornered or polygonal cross section.

A radial bead is configured on the housing preferably at the elevation of the clip spring. This bead imparts mechanical support to the elastic housing and contributes to a play-free fixing of the connector. Large leg lengths are formed when a spring arc portion or bight segment of the clip spring, which connects the legs of the clip, extends into the bead. The spring bight segment preferably lies as far as possible from the longitudinal axis of the connector whereby an advantageous spring characteristic with large spring deflections is achieved with low material stresses.

When manufacturing the spark plug connector, the prebent spring clip is placed in a predetermined position on a master-form core corresponding to the form of the spark plug receptacle and, thereafter, the housing material is introduced onto the unit formed from the master-form core and clip spring. The clip spring is now placed in a groove which is cut out on the master-form core. This master-form core is, in its form, the same as the contour of the spark plug receptacle of the finished spark plug connector. The groove cut out on the master-form core corresponds to the backcut in the contour of the connecting tip portion of the spark plug.

By placing the clip spring in the groove, the clip spring is axially fixed and the housing material can be applied without further measures. The clip spring is advantageously bent with a lower dimension with respect to the mouth opening and is thereby clamped to the core with a pretension. The core/clip spring unit is injection molded from all sides with rubber by injection molding. Because of the isostatic pressure from all sides, the spring does not lift off the contact location during the injection process. The leg segments, which lie under pretension against the core, remain exposed and are therefore capable of contact even though the entire core/clip spring unit is completely coated with rubber except for a free leg end projecting out of the housing as an electrical connection for the ignition cable. A removal of the rubber skin on the contact locations is not necessary notwithstanding the complete injection molding with rubber because these contact locations are already exposed because of the clip connection during the injection process.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
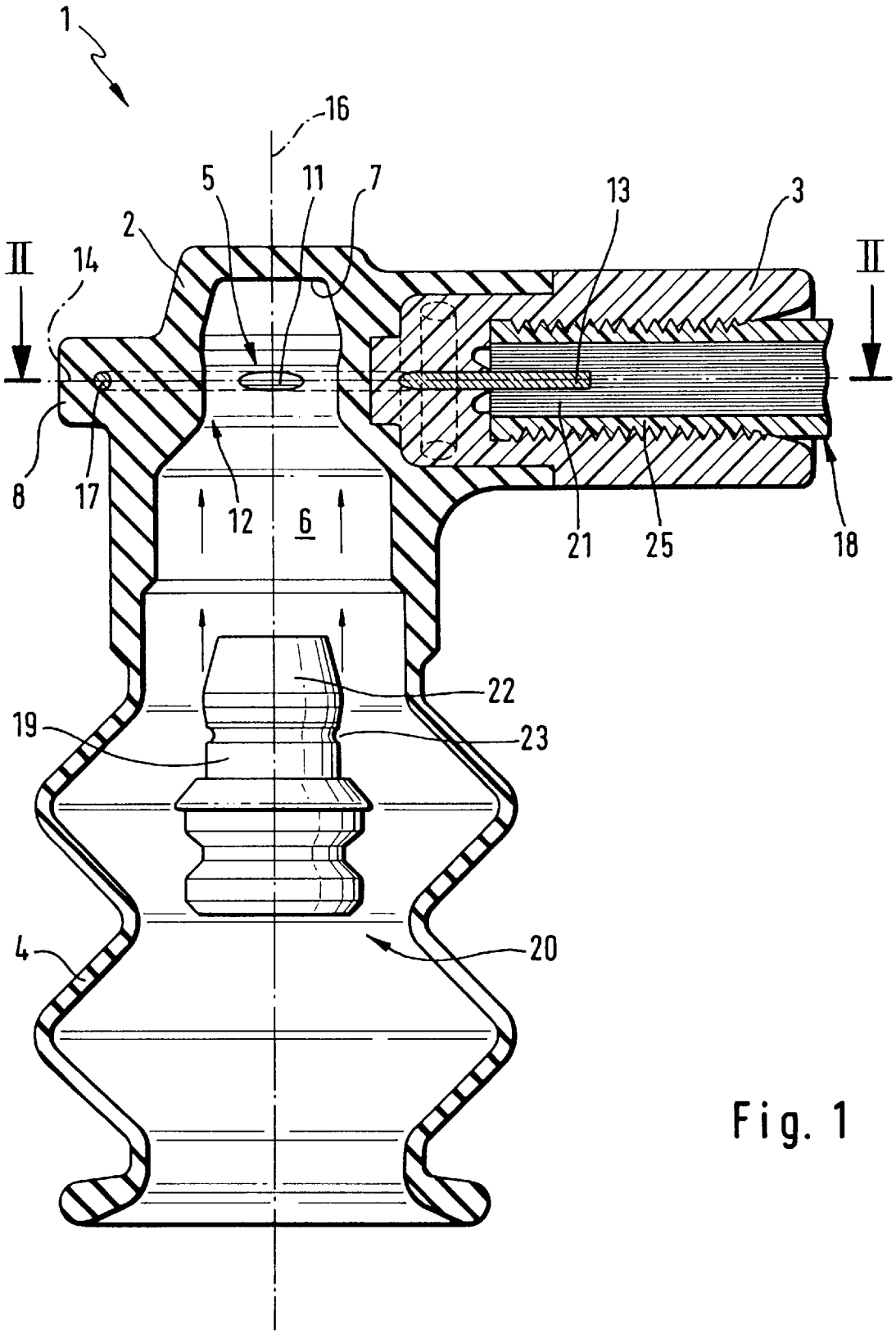
FIG. 1 is a side elevation view, in section, of the spark plug connector according to an embodiment of the invention.

In FIG. 1, a spark plug connector 1 is shown having a housing 2 made of electrically insulating material which is preferably rubber or the like. A spark plug receptacle 6 is formed in the interior of the housing 2 and has a contour substantially corresponding to the form of the connecting tip 19 of a spark plug 20. This connecting tip is insertable into the housing 2. The spark plug receptacle 6 is axially delimited by a housing roof 7 and is open at the opposite lying end.

The electrical contact with the spark plug takes place via a clip spring 5 which is embedded in the housing material. The clip spring is made of an electrically conductive spring steel wire. A free end 13 of the clip spring 5 is provided for connecting the connector 1 to an ignition cable 18. The rubber housing 2 is injection molded onto a cable holder 3 for receiving the ignition cable 18. The free end 13 of the clip spring 5 projects centrally into the cable holder 3 and defines a connecting pin 13 which connects electrically conductively into the core 21 of the ignition cable 18.

The clip spring 5 is configured to have two legs and is made of a spring wire. The clip spring 5 lies in a plane and is U-shaped when viewed in plan. The plane of the clip spring 5 lies at right angles to the longitudinal axis 16 of the spark plug receptacle 6 when in the mounted position and defines a contact plane 14. The legs (10, 11) of the clip spring lie tangentially to the wall of the spark plug receptacle 6 and project into the spark plug receptacle 6 with a portion of their periphery which is preferably half the cross section of the spring wire. The exposed segments of the clip legs (10, 11) for contacting delimit the narrowest diameter of the spark plug receptacle 6.

When the spark plug connector 1 is pushed onto the connecting tip 19 of the spark plug 20, the connecting tip 19 pushes axially into the spark plug receptacle 6 and pushes with its widened head 22 the legs (10, 11) of the clip spring 5 apart at the narrowest cross section of the receptacle 6. Only the connecting tip 19 of the spark plug 20 and a portion of the spark plug insulator are shown in FIG. 1 for clarity. The head 22 of the connecting tip 19 is inserted into the spark plug receptacle in the direction of the arrows. The head 22 of the connecting tip 19 is configured so as to be conically tapered to the free end. On the end facing away from the spark plug, the head 22 has a backcut 23 axially behind this end. This backcut 23 is defined by a slot having flat beveled and approximately conically-shaped surfaces at the connecting tip 19.

The spark plug receptacle 6 has a corresponding form in its upper end so that the spark plug head 22 can be accommodated without play. The conically-shaped expanded spark plug head 22 pushes the clip legs (10, 11) apart which latch into the backcut 23 of the spark plug head under the action of the restoring spring force. As the spark plug connector is axially pushed onto the spark plug, the legs (10, 11) latch into the backcut 23 after the largest diameter of the head 22 has passed the plane 14 of the clip spring 5 in the direction of the arrows.

The manufacture of the spark plug connector 1 takes place via injection molding or compression molding. The injection core for molding the spark plug receptacle 6 corresponds to the form of the spark plug head which later is to be accommodated therein. In its dimensions, the injection mold is configured to have an oversize so that it is larger than the form of the head of the spark plug whereby the spark plug receptacle 6 of the rubber housing lies approximately on the spark plug head when in the mounted position. The injection tool is described further hereinafter with respect to FIG. 3.

The mechanical strength of the housing 2, which is made of elastic rubber, is further improved with the configuration of a radial bead 8 at the elevation of the clip spring 5 (plane 14). The rubber bead 8 is configured at the elevation of the cable holder 3. The clip spring 5 is configured to be U-shaped and has a length such that the bight segment 17, which connects the legs, lies in or about the region of the radial rubber bead 8. Large leg lengths are achieved with a large spacing of the bight segment 17 from the longitudinal axis 16 of the connector 1 so that, for low material stresses in the spring wire, large spring deflections are obtained having adequate return forces.

The spring deflections of the long clip leg 11 as well as the elasticity of the rubber material of the housing 2 permanently ensure that the same push/pull forces for mounting and disconnecting the insert connection are required. The latching of the latch segment 12 in the backcut 23 of the spark plug 20, when mounting the spark plug holder 1, makes obvious to the touch that the electrical contact between the clip spring 5 and the connecting tip 19 of the spark plug 2 is established.

A corrugated bellows 4 is formed on the housing 2 next to the open end of the spark plug receptacle 6. The corrugated bellows 4 functions to shield the spark plug and the insulator thereof and lies, with its edge, against a radial shoulder of the spark plug, for example, the conventional hexagon for receiving a socket wrench. The corrugated bellows 4 is axially expandable and is always under a pretension in the axial direction when in the mounted state. The shielding can also seat on a part of the engine so that the spark plug is completely accommodated in the corrugated bellows 4 and electrical high-voltage flashovers from the surroundings are avoided. The corrugated bellows 4 is made of rubber in the embodiment shown and is configured as one piece with the housing 2 of the spark plug connector 1.

Figure 2:
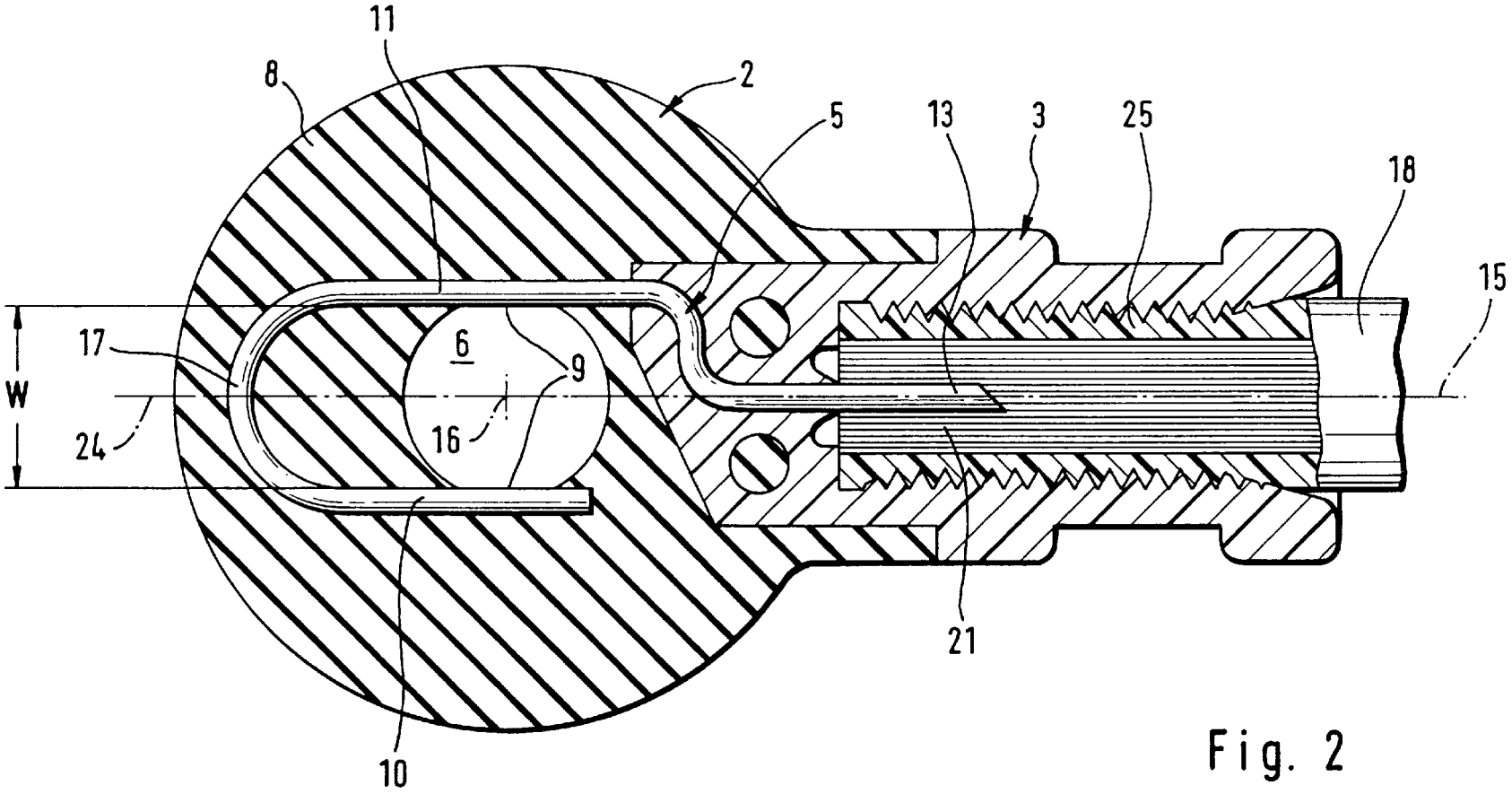
FIG. 2 is a section view of the spark plug connector taken along line II—II of FIG. 1; and, FIG. 3 is a section view of an injection molding tool for making the spark plug connector of the invention.

The section view of the spark plug 1 shown in FIG. 2 is in the plane 14 in which the clip spring 5 lies. The cable holder 3 accommodates the ignition cable 21 and is integrated into the rubber housing 2 at right angles to the spark plug receptacle 6. In the embodiment shown, the sleeve-shaped cable holder 3 comprises a rigid material which is not electrically conductive. During the manufacture of the spark plug connector, the cable holder 3 is coated with the rubber of the housing part and is so fixed to the housing. The clip spring 5 is bent from a spring steel wire to have a U shape. The spring steel wire has a circular cross section and the clip legs (10, 11) are configured to have different lengths. The longer clip spring leg 11 projects with its free end 13 into the cable holder 3. The longer clip leg 11 is bent by cropping in such a manner that the clip spring 5 is rotationally symmetrical. Accordingly, the clip legs (10, 11) have the same spacing from a fictitious rotational axis 24 which defines a longitudinal center axis and is coincident with the symmetrical axis 15 of the cable holder 3 in the built-in condition. The free end of the longer clip leg 11 lies on the symmetrical axis 15 and defines the connecting pin 13 onto which the ignition cable can be pushed. The ignition cable is introduced into the holder 3 which is made of a rigid material. The cable holder 3 has an internal thread into which an ignition cable 18 can be threadably engaged. The thread teeth then engage into a cable jacket 25 of the ignition cable 18 which can be made of an elastic or plastic material. When screwing in or threadably engaging the ignition cable 18 in the cable holder 3, the connecting pin 13 of the clip spring 5 pushes into the core 21 of the ignition cable 18 and defines the electrical connection. The clip spring 5 is embedded in the rubber material of the housing 2.

The parallel clip legs (10, 11) cut the circularly-shaped wall of the receptacle 6 at diametrically opposite lying locations. The exposed segments 9 of the clip legs (10, 11) are metallically bare and function to provide contact to the spark plug. The mouth width W of the clip spring 5 is, in the rest state, less than the smallest diameter of the spark plug head 22 of the spark plug 20 in the region of the groove defining the peripherally extending backcut 23 into which the contact segments 9 of the clip legs latch. The bight portion 17 of the clip spring connects the clip legs (10, 11) in a U-shape and lies close to the rubber bead 8. The contact segments 9 of the clip legs (10, 11) therefore are spaced with large lever arms from the spring bight portion 17 so that the clip legs can be pressed apart with little force and the connector can be pushed onto the spark plug and released therefrom in a simple manner. In the latched state, the clip spring 5 ensures a reliable electrical contact and a reliable mechanical hold of the holder on the spark plug 20.

The spark plug connector of the invention is especially suitable for internal combustion engines in handheld portable work apparatus.

Figure 3:
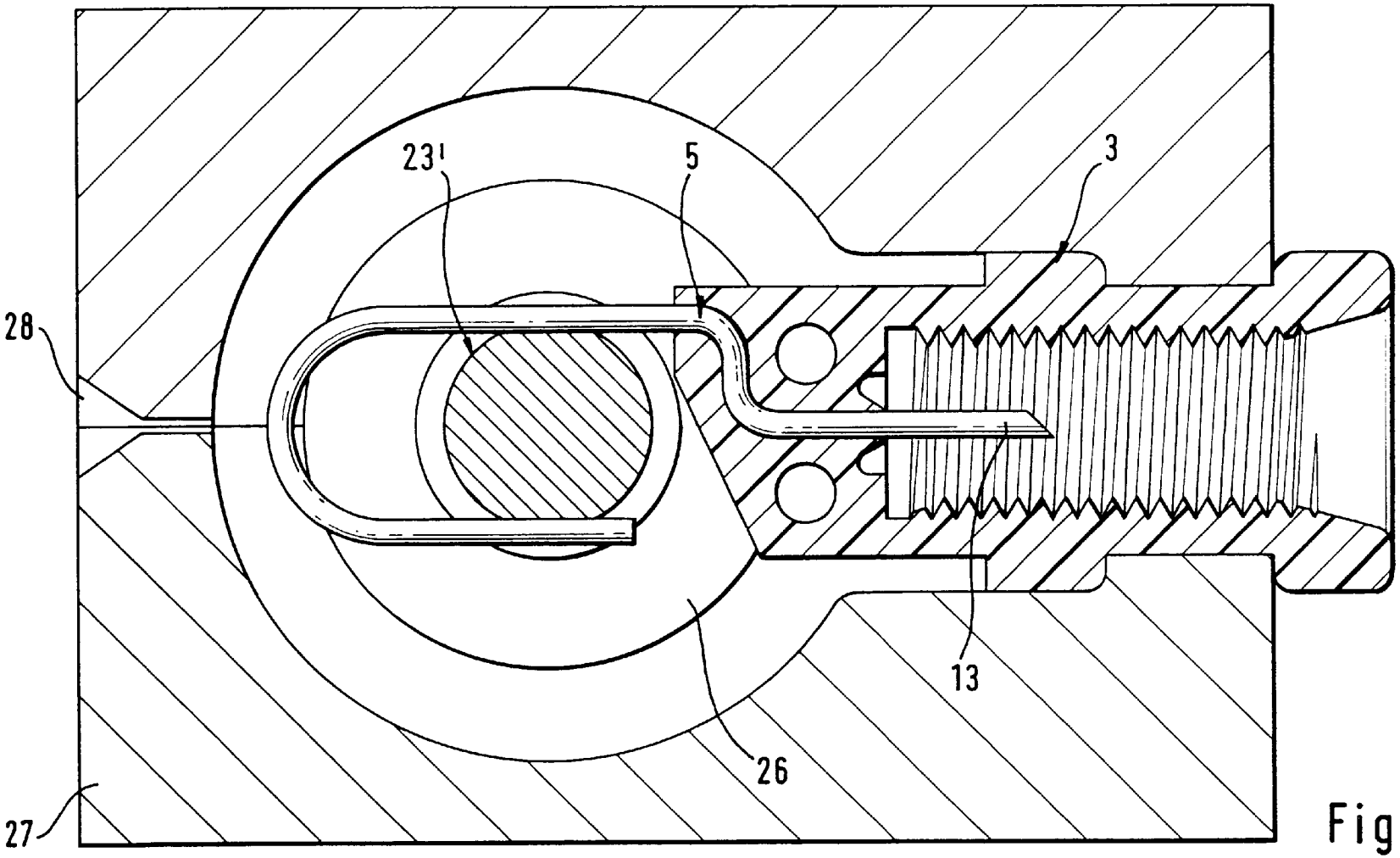

An injection molding tool for the spark plug connector is shown in FIG. 3. The injection molding tool comprises an external form shell 27 and an inner master-form core 26. As with molding tools of this kind, the mold core 26 is fixed within the outer shell 27 and forms the spark plug receptacle of the connector when decanting the model. In the embodiment, the mold shells 27 conjointly define the inlet 28 of the tool for the rubber to be injection molded. When setting up the work tool, the clip spring 5 is threaded into a groove 23' cut out on the core.

The core 26 corresponds to the form of the connector tip 19 and especially to the form of the head 22 (FIGS. 1 and 2). On the core 26, the groove 23' is formed in correspondence to the backcut of the head for latching the clip spring 5. The clip spring 5 has a smaller mouth opening than the diameter of the groove 23'. For this reason, the clip spring 5 is held under pretension when injection molding the connector housing so that, when removing the tool parts, the contact segments of the clip spring will be exposed in each case within the connector housing.

The clip spring 5 is joined with the cable holder 3 during injection molding of the housing. The spring with its free leg end projects into the cable holder 3 as a connecting pin 13. The cable holder 3 together with the clip spring 5 is placed in the injection-molding tool and fixes the axial position of the clip spring 5 in the provided plane of the connector housing. The cable holder 3 together with the clip spring 5 is injection molded into the rubber housing of the spark plug connector 1.

It is understood that the foregoing description is that of the preferred embodiments of the invention and that various changes and modifications may be made thereto without departing from the spirit and scope of the invention as defined in the appended claims.

What is claimed is:

1. A spark plug connector for connecting an ignition cable to a spark plug having a connecting tip, the spark plug connector comprising:

an electrically insulating housing made of elastic material and defining a receptacle for accommodating the spark plug therein;

said receptacle defining a longitudinal axis;

a clip spring for providing an electrical contact to the connector tip of said spark plug;

a cable holder for receiving the ignition cable therein;

said cable holder being connected to said housing;

said clip spring being embedded in said material of said housing;

said clip spring having legs which develop a restoring force when deflected from a rest position;

said legs having respective segments and said legs lying in a contact plane perpendicular to said longitudinal axis;

said segments being disposed in said receptacle to conjointly delimit a smallest diameter within said receptacle;

said segments being displaceable against said restoring force as said connecting tip enters said socket and said segments being accessible to said connecting tip for providing an electrical contact therewith; and, said clip spring being bent from a spring wire in said contact plane.

2. The spark plug connector of claim 1, wherein said clip spring is configured to have a U-shape.

3. The spark plug connector of claim 1, wherein said connecting tip has a backcut formed therein; and, said spark plug connector comprises: said housing having a roof wall axially delimiting said receptacle; and, said roof wall being spaced from said contact plane so as to permit said contact segments to latch into said backcut.

4. The spark plug connector of claim 1, wherein said connecting tip has a contour; and, wherein said spark plug connector further comprises said receptacle having a contour corresponding to said contour of said connecting tip.

5. The spark plug connector of claim 4, said receptacle lying in contact with said connecting tip without play.

6. The spark plug connector of claim 1, said spring wire having a circular cross section.

7. A spark plug connector for connecting an ignition cable to a spark plug having a connecting tip, the spark plug connector comprising:

an electrically insulating housing made of elastic material and defining a receptacle for accommodating the spark plug therein;

said receptacle defining a longitudinal axis;

a clip spring for providing an electrical contact to the connector tip of said spark plug;

a cable holder for receiving the ignition cable therein;

said cable holder being connected to said housing;

said clip spring being embedded in said material of said housing;

said clip spring having legs which develop a restoring force when deflected from a rest position;

said legs having respective segments and said legs lying in a contact plane perpendicular to said longitudinal axis;

said segments being disposed in said receptacle to conjointly delimit a smallest diameter within said receptacle;

said segments being displaceable against said restoring force as said connecting tip enters said socket and said segments being accessible to said connecting tip for providing an electrical contact therewith; and, one free end of said clip spring projecting into said cable holder and defining a connecting pin which conductively engages said ignition cable.

8. A spark plug connector for connecting an ignition cable to a spark plug having a connecting tip, the spark plug connector comprising:

an electrically insulating housing made of elastic material and defining a receptacle for accommodating the spark plug therein;

said receptacle defining a longitudinal axis;

a clip spring for providing an electrical contact to the connector tip of said spark plug;

a cable holder for receiving the ignition cable therein;

said cable holder being connected to said housing;

said clip spring being embedded in said material of said housing;

said clip spring having legs which develop a restoring force when deflected from a rest position;

said legs having respective segments and said legs lying in a contact plane perpendicular to said longitudinal axis;

said segments being disposed in said receptacle to conjointly delimit a smallest diameter within said receptacle;

said segments being displaceable against said restoring force as said connecting tip enters said socket and said segments being accessible to said connecting tip for providing an electrical contact therewith; and, said housing having an external bead formed thereon at the elevation of said clip spring.

9. The spark plug connector of claim 8, said clip spring having a bight segment connecting said legs to each other; and, said bight segment being embedded in said bead.

10. The spark plug connector of claim 9, said housing being made of rubber.

11. A method for making a spark plug connector for connecting an ignition cable to a spark plug having a connecting tip, the spark plug connector including: an electrically insulating housing made of elastic material and defining a receptacle for accommodating the spark plug therein; a clip spring at a predetermined position with respect to said receptacle for providing an electrical contact to the connector tip of said spark plug in a contact plane; said clip spring being bent from a spring wire in said contact plane and being embedded in said elastic material of said housing; said legs having respective segments and said segments being disposed in said receptacle to conjointly delimit a smallest diameter thereof; and, the method comprising the steps of:

placing said clip spring on a mold core corresponding to said receptacle at said predetermined position; and, then applying said elastic material to a unit of said mold core and said spring clip.

12. The method of claim 11, wherein said connecting tip has a backcut formed therein; and, wherein the method comprises the further steps of:

providing a groove in said mold core corresponding to said backcut; and, placing said legs of said clip spring in said groove.

13. A method for making a spark plug connector for connecting an ignition cable to a spark plug having a connecting tip, the spark plug connector including: an electrically insulating housing made of elastic material and defining a receptacle for accommodating the spark plug therein; a clip spring at a predetermined position with respect to said receptacle for providing an electrical contact to the connector tip of said spark plug in a contact plane; and, said clip spring being embedded in said elastic material of said housing; said legs having respective segments and said segments being disposed in said receptacle to conjointly delimit a smallest diameter thereof; and, the method comprising the steps of:

placing said clip spring on a mold core corresponding to said receptacle at said predetermined position;

bending said clip from a spring wire spring to have an undersize with respect to the mouth width (W);

clamping said clip spring to said mold core with a pretensioning so as to be in said contact plane; and, then applying said elastic material to a unit of said mold core and said spring clip.

14. The method of claim 13, wherein one of said legs of said clip spring has a free end projecting out of said housing to serve as an electrical connection; and, wherein said elastic material is applied to all of said unit except for said free end.

15. The method of claim 14, wherein the form of said housing is imparted thereto by injection molding or compression molding.

16. The method of claim 15, comprising the further steps of:

providing a sleeve-shaped cable holder for said ignition cable so that said free end projects thereinto for establishing an electrical connection to an ignition cable; and, placing said clip spring and said cable holder in an injection molding or press molding apparatus and molding said cable holder into said housing.

17. The spark plug connector of claim 1, wherein one free end of said clip spring projects into said cable holder and defines a connecting pin which conductively engages said ignition cable.

18. The spark plug connector of claim 1, wherein said housing has an external bead formed thereon at the elevation of said clip spring.

19. The spark plug connector of claim 18, said clip spring having a bight segment connecting said legs to each other; and, said bight segment being embedded in said bead.

20. The spark plug connector of claim 19, said housing being made of rubber.

21. The spark plug connector of claim 7, wherein said clip spring is configured to have a U-shape.

22. The spark plug connector of claim 7, wherein said connecting tip has a backcut formed therein; and, said spark plug connector further comprises: said housing having a roof wall axially delimiting said receptacle; and, said roof wall being spaced from said contact plane so as to permit said contact segments to latch into said backcut.

23. The spark plug connector of claim 7, wherein said connecting tip has a contour; and, wherein said spark plug connector further comprises said receptacle having a contour corresponding to said contour of said connecting tip.

24. The spark plug connector of claim 23, said receptacle lying in contact with said connecting tip without play.

25. The spark plug connector of claim 7, said clip spring being bent from a spring wire in said contact plane.

26. The spark plug connector of claim 7, said spring wire having a circular cross section.

27. The spark plug connector of claim 7, wherein said housing has an external bead formed thereon at the elevation of said clip spring.

28. The spark plug connector of claim 27, said clip spring having a bight segment connecting said legs to each other; and, said bight segment being embedded in said bead.

29. The spark plug connector of claim 28, said housing being made of rubber.

30. The spark plug connector of claim 8, wherein said clip spring is configured to have a U-shape.

31. The spark plug connector of claim 8, wherein said connecting tip has a backcut formed therein; and, said spark plug connector further comprises: said housing having a roof wall axially delimiting said receptacle; and, said roof wall being spaced from said contact plane so as to permit said contact segments to latch into said backcut.

32. The spark plug connector of claim 8, wherein said connecting tip has a contour; and, wherein said spark plug connector further comprises said receptacle having a contour corresponding to said contour of said connecting tip.

33. The spark plug connector of claim 32, said receptacle lying in contact with said connecting tip without play.

34. The spark plug connector of claim 8, said clip spring being bent from a spring wire in said contact plane.

35. The spark plug connector of claim 34, said spring wire having a circular cross section.

36. The spark plug connector of claim 8, wherein one free end of said clip spring projects into said cable holder and defines a connecting pin which conductively engages said ignition cable.

* * * * *